United States Patent [19]

Bloyce et al.

[11] 4,296,886

[45] Oct. 27, 1981

[54] SHOWER FITTINGS

[75] Inventors: Lionel T. Bloyce, Maidenhead; Michael J. Morley, Bray, both of England

[73] Assignee: Albany International Corporation, Albany, N.Y.

[21] Appl. No.: 76,292

[22] Filed: Sep. 17, 1979

[30] Foreign Application Priority Data

Sep. 21, 1978 [GB] United Kingdom ..... 37666/78

[51] Int. Cl.[3] ..... B05B 3/18

[52] U.S. Cl. ..... 239/264; 134/172; 162/276; 239/288.5; 239/566

[58] Field of Search ..... 239/225, 264, 268, 288.5, 239/380, 566, 567, 103; 162/275, 276; 134/172, 198

[56] References Cited

U.S. PATENT DOCUMENTS

| | | | |
|---|---|---|---|
| 2,097,337 | 10/1937 | Oliver | 239/225 |
| 2,151,357 | 3/1939 | Reitzel | 162/276 |
| 2,316,212 | 4/1943 | Alles | 239/566 |
| 3,175,768 | 3/1965 | Hammelmann | 239/566 |
| 3,617,441 | 11/1971 | Farrell | 134/172 |

*Primary Examiner*—Robert B. Reeves
*Assistant Examiner*—Michael J. Forman
*Attorney, Agent, or Firm*—Kane, Dalsimer, Kane, Sullivan and Kurucz

[57] ABSTRACT

The invention relates to shower fittings especially those used in the paper and board making industries. The shower fitting incorporates at least one jet for directing on to a surface a jet of liquid which is suitable for cleaning and/or reconditioning the surface. The jet or jets are normally mounted in a tube to which the liquid is supplied and which is reciprocated across the surface to ensure that the entire width of the surface is treated and to avoid damage to the surface that might result if a jet of liquid is directed constantly at the same area of the surface. The invention is concerned with the problem of ensuring adequate support and protection for the tube. In one particular embodiment, the tube 1 is mounted for reciprocation inside a support tube 3. Support bushes 2 spaced along the axial length of the tube 1 ensure adequate support while protection is provided by the outer tube 3. The tube 1 carries a plurality of jets 7 and the outer tube has a slot 13 aligned with the jets 7 to allow liquid emerging from the latter to reach the surface. Driving means for example an hydraulically-actuated motor 10 is mounted at one end of the outer tube 3 and is connected to the inner tube 1 to reciprocate the latter. Treatment liquid is supplied to the inner tube 1 via one end thereof.

4 Claims, 3 Drawing Figures

SHOWER FITTINGS

BACKGROUND OF THE INVENTION

This invention relates to shower fittings and has particular although not exclusive reference to shower fittings used in the paper and board making industry. Such fittings are used to clean and/or recondition conveying surfaces that are used at various stages in the paper and board making processes.

The shower fitting conventionally comprises a hollow tube apertured along its axial length at spaced intervals to receive jets. The tube is supported at both ends and has a mechanism adapted to reciprocate the tube along its axis. A cleaning and/or conditioning liquid is fed to the tube via a flexible connector. The tube is usually of a considerable length with the result that the mechanism must be of robust construction to reciprocate the weight of the tube and the fluid it contains when it is in use.

The fitting is mounted adjacent the surface to be cleaned and/or reconditioned and is exposed to damage which can result in the tube becoming distorted and in the efficiency of the jets becoming impaired.

SUMMARY OF THE INVENTION

According to the present invention a shower fitting comprises a first tubular member adapted to be connected to a source of fluid, the first member having a series of spray jets mounted in its wall, the jets being aligned and spaced along the length of the first member, a second tubular member within which the first member and the jets are located, the first member being mounted for longitudinal movement within the second member on support means at each end thereof and at spaced intervals between the ends, the wall of the second member having a longitudinal slot aligned with the spray jets to permit fluid discharged therefrom to emerge from the second member, and driving means for moving the first member.

The first tubular member may be supported within the second tubular member by means of a series of spaced bearing bushes.

The first tubular member may be connected at one end to the driving means, and, at the other end, is, in use, connected to the source of fluid. The other end may extend into a header chamber itself supplied with fluid via a fixed, rigid supply conduit. The driving means may be located in the header chamber.

By way of example only, an embodiment of the invention will now be described in greater detail with reference to the accompanying drawings of which:

DETAILED DESCRIPTION OF THE INVENTION

The embodiment which is suitable for use in paper making equipment comprises a first, inner tube 1 mounted upon spaced bushes 2 for reciprocatory movement inside a second, outer tube 3. The number of bushes employed depends upon the axial length of the tube 1, it being advisable to have bushes spaced at suitable intervals along the length of the tube. At the right-hand end (as seen in FIG. 1) of the outer tube 3 is an internal guide bush 4 of anti-friction material that supports the right-hand end of the inner tube 1.

Figure 2:
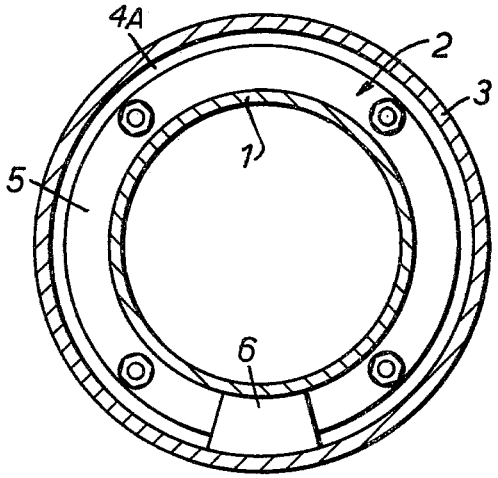
FIG. 2 is a section on an enlarged scale on the line II—II of FIG. 1.
Figure 3:
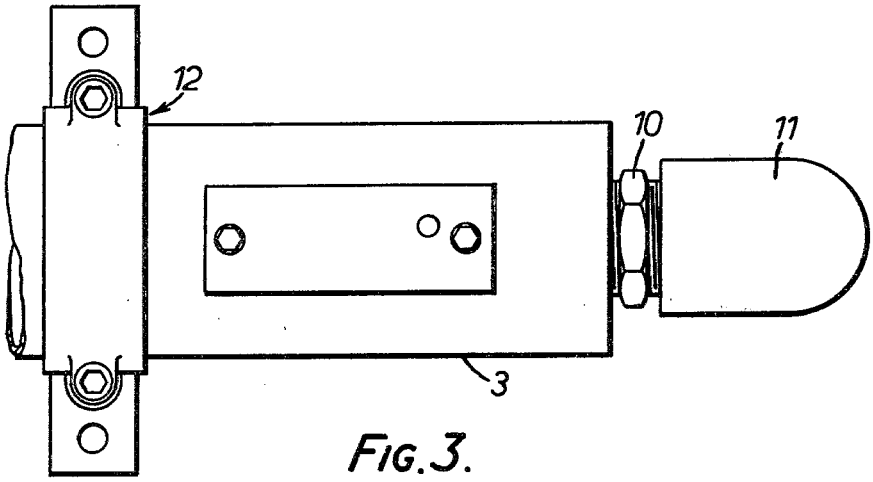
FIG. 3 is a plan view on an enlarged scale of part of the embodiment shown in FIG. 1.

Guide bush 4 is secured to the inner surface of the outer tube 3 but the bushes 2 are secured to the inner tube 1 and move with it in a manner described below. Each bush 2 consists of a ring of an anti-friction material 4, bolted to a support ring 5 itself secured to the inner tube 1. As can be seen from FIG. 2, both the ring of anti-friction material and the support ring 5 are "gapped" as at 6.

Figure 1:
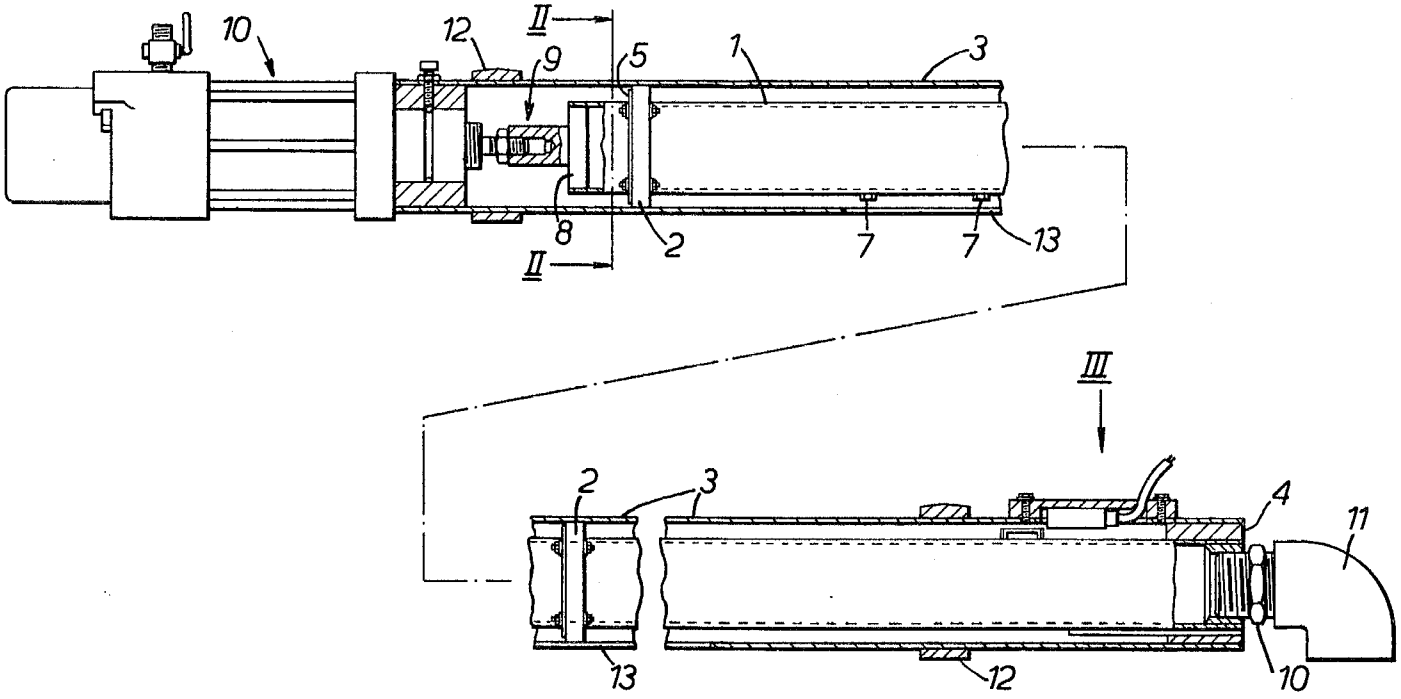
FIG. 1 is an elevation partly in section of the embodiment.

The inner tube 1 is apertured at spaced points along its length to receive jets of which only two are shown in FIG. 1 and referenced 7. The points lie on a straight line on the lower (as seen in FIG. 1) surface of the inner tube 1 and the line is parallel to the longitudinal axis of the inner tube 1.

The left-hand end of the inner tube 1 is closed by a plug 8 linked by a connector 9 to the motor of a motor unit 10 for reciprocating the inner tube 1 as will be described later. The connector 9 is adjustable in length and is used to determine the initial starting position of the inner tube.

The other, right-hand end of the inner tube 1 has a nipple screwed into it, the nipple carrying a 90° elbow 11 joined to a flexible tube (not shown). The elbow 11 is not essential and the flexible tube may be connected directly to the tube 1.

As has been explained above, the inner tube 1 is mounted for reciprocatory movement inside the outer tube 3. The tube 3 is an axial length slightly greater than that of the inner tube 1 and is supported upon brackets 12, the embodiment having two such brackets positioned adjacent the ends of the outer tube 3. The brackets 12 are fixed to a convenient point on the equipment with which the embodiment is associated.

The outer tube 3 has a longitudinal slot 13 in its lower surface, the slot lying along the line of jets 17 and being of a length such that, at all positions of the inner tube 1, the jets 7 can discharge through the slot. The slot also lies centrally within the gap 6 in the bushes 2.

The motor unit 10 includes an annular collar 14 which fits into the left-handed end of the outer tube 3 as seen in FIG. 1 and is secured on position by radial screws 15 of which one is shown in FIG. 1.

In the embodiment shown, the motor is an hydraulically-operated piston-cylinder motor, the piston being fixed to the connector 9 referred to above.

Reciprocation of the inner tube 1 within the outer tube 3 may be controlled in any well-known manner. For example, control may be effected, in the case of hydraulically- or pneumatically-driven motors by changeover valves operated by control rods or the like linked to a movable member, e.g. the piston of the motor. Alternatively, in the case of a pneumatic motor, limit switches actuated by movement of the inner tube 1 or a movable component associated therewith may be used.

The embodiment shown in the drawings employs a proximity switch represented by block 16 to detect reciprocatory movement of the inner tube 1. A series of three permanent magnets fixed to the inner tube 1 maintain the switch in an operated condition through the total movement of the tube. In event that the tube 1 stops, the proximity switch operates to shut off the supply of treatment liquid to the tube and possible damage to a surface being cleaned and/or conditioned by a high pressure jet concentrated on a limited area of the surface is avoided.

It will, of course, be understood that other methods of detecting movement of the tube 1 may be employed.

The length of the tubes 1 and 3 will be determined by the width of the surface to be cleaned and/or reconditioned and by the stroke of the tube 1. The stroke is related to the spacing of the jets. The speed of reciprocation may be adjustable.

The embodiment is installed over the surface by means of the brackets 12, the flexible tube is connected to a source of treatment liquid, usually water, of a pressure suitable for the type of surface. Motor 10 is joined to a source of hydraulic driving fluid. Thus, in use, sprays of treatment liquid emerge from the jets 7 and the inner tube 1 is reciprocated within the outer tube 3 so that the sprays traverse parts of the surface.

The sprays may be of any desired shape but normally they are of the so-called needle configuration. The shape of the spray is, of course, determined by the type of jet used.

The motor may be of a construction other than that described above. A pneumatic motor may be used, an electro-magnetic device or an electric motor. In the latter case, reciprocating movement of the inner tube 1 is produced by means of a suitable drive, reversal of the direction of movement being obtained either by reversing the direction of rotation of the electric motor or by means of a gear box.

In the embodiment described above, treatment liquid is fed via a flexible supply tube to the inner tube 1. In an alternative embodiment, the outer tube 3 is adapted to provide at one end thereof a header chamber to which treatment liquid is fed via a fixed rigid supply tube. The end of the inner tube 1 extends into the header chamber, leakage of liquid along the moving surface of the tube 1 being prevented by suitable seals. The alternative dispenses with the need for flexible supply tubes which, in use, constitute a possible hazard.

It will be appreciated that the inner tube 1 is supported along its length by the outer tube 3 which also protects the inner tube 1 from damage.

The jets 7 are also protected by the outer tube 3 from damage because they lie wholly within that tube.

What is claimed is:

1. A shower fitting comprising in combination a first tubular member with an interior passageway therethrough, closure means at one end of said passageway, fluid connection means positioned at the other end of said first member to enable the passageway to be connected to a source of fluid, a series of aligned spray jets mounted upon the said first tubular member at spaced intervals along the length thereof and being in communication with said passageway, a second tubular member, said first tubular member being housed within said second tubular member, said spray jets being wholly contained within said second tubular member, support means at the ends of said second tubular member, further support means located at spaced points along the length of said first tubular member and being secured to the latter, said support means and said further support means supporting said first tubular member within said second tubular member for reciprocatory movement relatively thereto, a longitudinal slot in said second tubular member, said slot being aligned with said spray jets and permitting fluid discharged therefrom to emerge from said second member, driving means mounted upon said second tubular member, and drive connection means extending within the second member from the driving means to said closure means to impart reciprocatory movement to said first tubular member.

2. A shower fitting as claimed in claim 1 in which said fluid connection means comprises a header chamber into which said first member extends, and a fluid inlet on said chamber for connection to said fluid source.

3. A shower fitting as claimed in claim 2 and further comprising a rigid supply conduit connected at one end to said fluid inlet and at the other end to said fluid source.

4. A shower fitting as claimed in claim 3 in which said driving means is located in said header chamber.

* * * * *